US005246548A

United States Patent [19]

Aston et al.

[11] Patent Number: 5,246,548

[45] Date of Patent: Sep. 21, 1993

[54] PITCH CONTROL

[75] Inventors: David A. Aston, Oakville; John K. Hochu, Mississauga, both of Canada

[73] Assignee: Dearborn Chemical Company Limited, Mississauga, Canada

[21] Appl. No.: 967,327

[22] Filed: Oct. 28, 1992

[30] Foreign Application Priority Data

Jan. 13, 1992 [CA] Canada ..... 2059526

[51] Int. Cl.[5] ..... D21F 1/32

[52] U.S. Cl. ..... 162/199; 162/DIG. 4

[58] Field of Search ..... 162/199, DIG. 4

[56] References Cited

U.S. PATENT DOCUMENTS 3,619,351 11/1971 Kolosh ..... 162/72

3,992,249 11/1976 Farley ..... 162/72

4,765,867 8/1988 Dreisbach et al. ..... 162/72

4,895,622 1/1990 Barnett et al. ..... 162/199

4,964,955 10/1990 Lamar et al. ..... 162/164.6

4,995,944 2/1991 Aston et al. ..... 162/DIG. 4

5,098,520 3/1992 Begala ..... 162/168.1

5,167,767 12/1992 Owiti et al. ..... 162/DIG. 4

*Primary Examiner*—Peter Chin

*Attorney, Agent, or Firm*—James P. Barr

[57] ABSTRACT

A method for the control of pitch in paper making machine dryer fabrics or equipment which are not in continuous contact with process water comprising applying to the fabrics or equipment, a water-soluble or water-dispersible cationic polymer and a water-soluble or water dispersible anionic aromatic polymer.

6 Claims, 1 Drawing Sheet

No.1 P.M. Dryer Section Schematic

The Third (11 cans) and Fourth (6 cans) dryer sections are similar to the Second

PITCH CONTROL

FIELD OF THE INVENTION

This invention relates to the control of pitch in papermaking machines, and more particularly to a method of applying a two component polymeric chemical treatment to paper machine dryer fabrics or other paper machine equipment parts which are not in contact with the process water to effectively inhibit or prevent the build-up of pitch deposits.

BACKGROUND OF THE INVENTION

It is well known that "pitch" can accumulate in various areas of papermaking machinery causing significant problems. The term "pitch" as used herein, refers to the sticky materials which form insoluble deposits in pulp and paper making processes. These sticky materials may originate from the wood from which the paper is made, or as more recycled paper is being used in paper making processes, the term is frequently used as a more general term to include all sticky material which is soluble in organic solvents but not soluble in water, and includes, for example, ink or adhesive material present in recycled paper. The depositing material originating from recycled fiber has also been called "stickies", however, for purposes of this invention, the term "pitch" shall include not only naturally occurring pitch particles derived from paper pulp, but also any synthetic sticky materials derived from recycled fiber and which form insoluble deposits in paper making processes.

Pitch is known to accumulate at various points in the papermaking system. For example, it is known to block the paper machine felts and thus hinder drainage of the paper web. It can adhere to the wires or drying cylinders causing it to pick holes in the paper. It may also deposit on press rolls, dryer fabric or other like equipment which come into direct or indirect contact with the paper sheet or paper machine felts. In fact, all paper machine fabrics and many of the rolls which contact the fabrics or paper sheet will, from time to time, accumulate deposits of pitch.

Many materials and techniques have been used in an attempt to eliminate these problems. Traditional techniques to control these deposits have been to either shut down the production equipment to clean off the affected equipment parts or to treat all of the contaminants in the system with various chemical compositions such as inorganic treatments including talc or anionic dispersants. However, conventional dispersants have been generally ineffective in closed systems due to the accumulation and build-up of pitch. In such closed systems the pitch particles must be removed from the water system in a controlled way without being allowed to accumulate on the paper machine felts or rolls or, for example, the pipe work used in the paper making machinery.

It is known to spray aqueous formulations of certain cationic polymers and/or cationic surfactants onto various paper machine surfaces which are in contact with the process water and which are prone to deposit formations to reduce the build-up of these deposits. However these treatments have been limited to those areas of the papermaking process which is in contact with the process water in order to facilitate removal of the pitch deposits from the system. It has now been found, that those areas of the papermaking machine which are not in contact with the process water, i.e. the dryer fabrics, dryer rolls, and the like, may advantageously be treated with polymeric compositions to effectively control pitch from depositing thereon.

SUMMARY OF THE INVENTION

Figure 1:
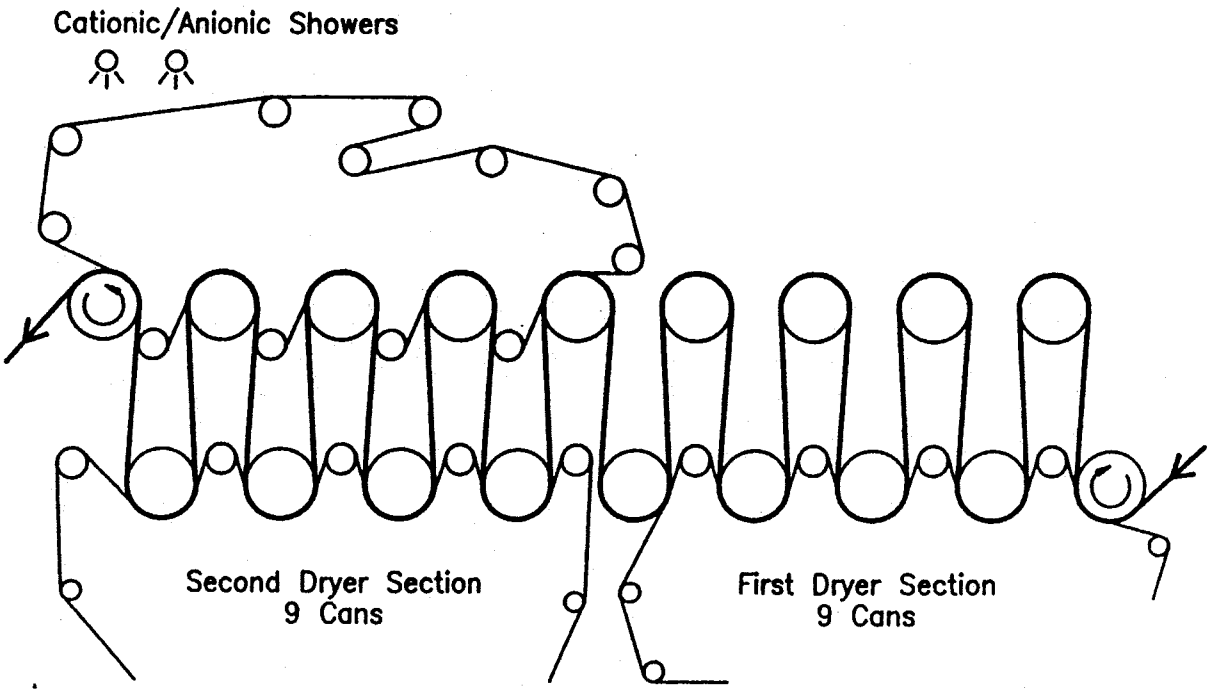
FIG. 1 is a schematic of the dryer section of a paper making machine.

It is an object of this invention to provide a method of controlling or preventing the build-up of pitch on paper machine dryer fabrics and other equipment which is not in contact with the process water.

In accordance with the present invention, there has been provided a method wherein the build-up of pitch on the dryer fabrics or equipment of papermaking machinery which are not in contact with process water can be controlled or prevented by applying thereto, a water soluble or water dispersible cationic polymer and an anionic water soluble or water dispersible aromatic polymer.

DETAILED DESCRIPTION

The present invention is directed to a method for controlling the deposition of pitch onto paper making machine dryer fabrics, dryer rolls, or like equipment which are not in continuous contact with process water, which comprises applying to the surfaces of the dryer fabrics or equipment a water-soluble or water-dispersible cationic polymer and a water-soluble or water dispersible anionic aromatic polymer.

It has now been found that by applying cationic and anionic polymers to the dryer fabrics or other equipment surfaces of a papermaking machine which are not in contact with process water, that it is possible to provide a coating on the dryer fabrics or equipment surfaces, which prevents pitch from adhering to them. The polymers can be applied by any convenient means, such as, for example, by means of a hopper or other applicator, however it is preferred that the polymers are sprayed onto the equipment. In a particularly preferred embodiment, the anionic product is applied subsequent to the application of the cationic product although it is possible to simultaneously apply both polymeric treatments through the same spray nozzle. By producing a coating on the surfaces in this way there is a substantial reduction in the build-up of deposits which thereby improves the paper machine runability which in turn improves the sheet quality which results from the improved performance.

A wide variety of different water-soluble or water dispersible cationic polymers can be employed. These will generally have a molecular weight from 1000 to 500,000, preferably a molecular weight from 1000 to 100,000, and most preferably from 20,000 to 50,000. The charge density (determined by e.g., streaming current potential titration) of suitable polymers is 0.1 to 10, especially 2 to 8, meq/g.

Preferred cationic polymers for use in this invention include for instance, polyethyleneimines, especially low molecular weight polyethyleneimines, for example of molecular weight up to 5,000 and especially up to 2,000, including tetraethylene pentamine and triethylene tetramine, as well as various other polymeric materials containing amino groups such as those described in U.S. Pat. Nos. 3,250,664, 3,642,572, 3,893,885 and 4,250,299 but it is as generally preferred to use protonated or quaternary ammonium polymers. These quaternary ammonium polymers are preferably derived from ethylenically unsaturated monomers containing a quaternary ammonium group or are obtained by reaction between an epihalohydrin and one or more amines such as those obtained by reaction between a polyalkylene polyamine and epichlorohydrin, or by reaction between epichlorohydrin dimethylamine and either ethylene diamine or polyalkylene polyamine. Other cationic polymers which can be used include dicyandiamide-formaldehyde condensates. Polymers of this type are disclosed in U.S. Pat No. 3,582,461. Either formic acid or ammonium salts, and most preferably both formic acid and ammonium chloride, may also be included as polymerization reactants. One dicyandiamide-formaldehyde type polymer found effective for film formation contains as its active ingredient about 50 weight percent of polymer believed to have a molecular weight between about 20,000 to 50,000.

Typical cationic polymers which can be used in the present invention and which are derived from an ethylenically unsaturated monomer include homo- and copolymers of vinyl compounds such as vinyl pyridine and vinyl imidazole which may be quaternized with, say, a $C_1$ or $C_{18}$ alkyl halide, a benzyl halide, especially a chloride, or dimethyl or diethyl sulphate, or vinyl benzyl chloride which may be quaternized with, say, a tertiary amine of formula $NR_1R_2R_3$ in which $R_1$ $R_2$ and $R_3$ are independently lower alkyl, typically of 1 to 4 carbon atoms, such that one of $R_1$ $R_2$ and $R_3$ can be $C_1$ to $C_{18}$ alkyl; allyl compounds such as diallyldimethyl ammonium chloride; or acrylic derivatives such as a dialkyl aminomethyl(meth)acrylamide which may be quaternized with, say, a $C_1$ to $C_{18}$ alkyl halide, a benzyl halide or dimethyl or diethyl sulphate, a methacrylamido propyl tri($C_1$ to $C_4$ alkyl, especially methyl) ammonium salt, or a(meth)acryloyloxyethyl tri($C_1$ to $C_4$ alkyl, especially methyl) ammonium salt, said salt being a halide, especially a chloride, methosulphate, ethosulphate or $1/_n$ of an n-valent anion. These monomers may be copolymerized with a(meth)acrylic derivative such as acrylamide, an acrylate or methacrylate $C_1$–$C_{18}$ alkyl ester or acrylonitrile. Typically such polymers contain 10–ϕmol % of recurring units of the formula:

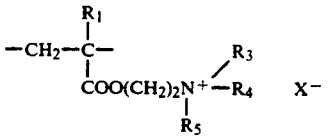

and 0–90 mol % of recurring units of the formula:

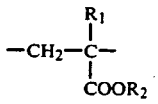

in which $R_1$ represents hydrogen or a lower alkyl radical, typically of 1–4 carbon atoms, $R_2$ represents a long chain alkyl group, typically of 8 to 18 carbon atoms, $R_3$, $R_4$ and $R_5$ independently represent hydrogen or a lower alkyl group while X represents an anion, typically a halide ion, a methosulfate ion, an ethosulfate ion or 1/n of a n valent anion.

Other quaternary ammonium polymers derived from an unsaturated monomer include the homo-polymer of diallyldimethylammonium chloride which possesses recurring units of the formula:

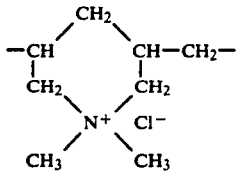

as well as copolymers thereof with an acrylic acid derivative such as acrylamide.

Other polymers which can be used and which are derived from unsaturated monomers include those having the formula:

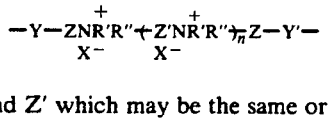

where Z and Z' which may be the same or different is $-CH_2CH{=}CHCH_2-$ or $-CH_2-CHOHCH_2-$, Y and Y', which may be the same or different, are either X or —NH'R", X is a halogen of atomic weight greater than 30, n is an integer of from 2 to 20, and R' and R" (I) may be the same or different alkyl groups of from 1 to 18 carbon atoms optionally substituted by 1 to 2 hydroxyl groups; or (II) when taken together with N represent a saturated or unsaturated ring of from 5 to 7 atoms; or (III) when taken together with N and oxygen atom represent the N-morpholino group, which are described in U.S. Pat. No. 4397743. A particularly preferred such polymer is poly(dimethylbutenyl) ammonium chloride bis-(triethanol ammonium chloride).

Another class of polymer which can be used and which is derived from ethylenically unsaturated monomers includes polybutadienes which have been reacted with a lower alkyl amine and some of the resulting dialkyl amino groups are quaternized. In general, therefore, the polymer will possess recurring units of the formula:

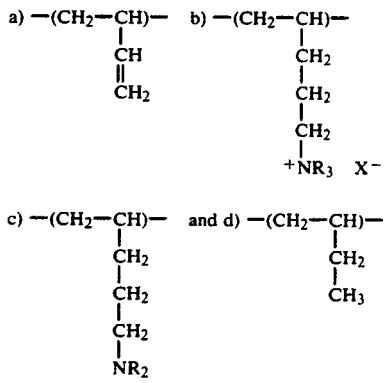

in the molar proportions a:b:c:d, respectively, where R represents a lower alkyl radical, typically a methyl or ethyl radical. It should be understood that the lower alkyl radicals need not all be the same. Typical quaternizing agents include methyl chloride, dimethyl sulfate and diethyl sulfate. Varying ratios of a:b:c:d may be used with the amine amounts (b+c) being generally from 10–90% with (a+c) being from 90–10%. These polymers can be obtained by reacting polybutadiene with carbon monoxide and hydrogen in the presence of an appropriate lower alkyl amine.

Of the quaternary ammonium polymers which are derived from epichlorohydrin and various amines, particular reference should be made to the polymers described in British Specification Nos. 2085433 and 1486396. A typical amine which can be employed is N,N,N',N'-tetra-methylethylenediamine as well as ethylenediamine used together with dimethylamine and triethanolamine. Particularly preferred polymers of this type for use in the present invention are those having the formula:

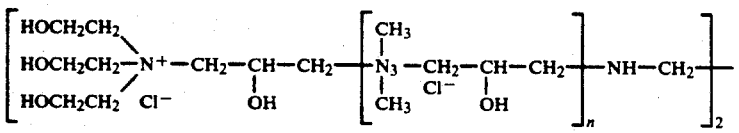

where N is from 0–500, although, of course, other amines can be employed.

Other polymers which can be used include cationic lignin, starch and tannin derivatives, such as those obtained by a Mannich type reaction of tannin (a condensed polyphenolic body) with formaldehyde and an amine, formed as a salt e.g. acetate, formate, hydrochloride or quaternized, as well as polyamine polymers which have been crosslinked such as polyamideamine/polyethylene polyamine copolymers crosslinked with, say, epichlorohydrin.

The preferred cationic polymers of this invention also include those made by reacting dimethylamine, diethylamine, or methylethylamine, preferably either dimethylamine or diethylamine with an epihalohydrin, preferably epichlorohydrin, such as those disclosed in U.S. Pat. No. 3,738,945 and CA-A-1,096,070. Such polymers reportedly contain as their active ingredients about 50 weight percent of polymers having molecular weights of about 10,000 to 250,000.

In addition polyquaternary polymers derived from (a) an epihalohydrin or a diepoxide or a precursor thereof especially epichloro- or epibromo-hydrin, (b) an alkylamine having an epihalohydrin functionality of 2, especially a dialkylamine having 1 to 3 carbon atoms such a dimethylamine and (c) ammonia or an amine which has an epihalohydrin functionality greater than 2 and which does not possess any carbonyl groups, especially a primary amine or a primary alkylene polyamine such as diethylaminobutylamine, dimethylamino propylamine and ethylene diamine. Such polymers can also be derived from a tertiary amine or a hydroxyalkylamine. Further details regarding such polymers are to be found in, for example, GB-A-2085433, U.S. Pat. No. 3,855,299 and Re. Patent 28,808.

The anionic polymers employed are water-soluble or water dispersible aromatic polymers, and are preferably, sulphonated and/or hydroxylated polymeric compounds such as kraft lignins, lignosulphonates, polynaphthalene sulphonates, tannins and sulphonated tannins and the like and mixtures thereof. The term "aromatic polymer" as used herein refers to those polymers having an aromatic group as the prinicipally recurring unit in the polymer. Thus while the aromatic polymers of this invention may be either homopolymers or copolymers, it is considered important that the aromatic group in the polymer be present in at least 50% on a molar basis.

It will, of course, be appreciated that the anionic polymers of this invention can be used either in the free acid form or in the form of water soluble salts thereof.

The effectiveness of these particular polymers was surprising due to the relative ineffectiveness of other similar anionic polymers such as sucrose, carboxymethylcellulose, polymethacrylates, maleic anhydride copolymers and starch.

The polymers of this invention will normally be formulated as separate concentrated aqueous solutions, the concentration of each polymer being, in general, from 0.1 to 50% by weight and preferably from 1 to 20% by weight. These concentrates will normally be further diluted to an applied concentration from 1 to 10,000 ppm, especially from 1 to 5,000 ppm. The dilution should, of course, be made with water which is sufficiently pure that it does not reverse the charge of the diluted system. However, it should be noted that when water-dispersible polymers are used, that it may be advantageous to employ a water-miscible solvent to aid in solubilizing these polymers in an aqueous solution. The choice of a particular solvent is not per se critical to the invention and will depend on the solubility of the particular polymer used. Those of ordinary skill in the art can readily determine an appropriate solvent by conventional means.

The compositions of this invention may also contain wetting agents (i.e. materials capable of reducing the surface tension of water) and other additives conventionally used for pitch control. In addition, cationic or nonionic surfactants may be used with the cationic polymers and anionic or nonionic surfactants may be used with anionic polymers.

The following examples are provided to illustrate the present invention in accordance with the principles of this invention, but are not to be construed as limiting the invention in any way except as indicated in the appended claims. All parts and percentages are by weight unless otherwise indicated.

EXAMPLE 1

This example demonstrates the effectiveness of applying to paper machine dryer fabrics the combination of cationic polymers with anionic aromatic polymers for controlling and/or preventing the deposition of pitch. The polymeric treatments were applied separately to a papermaking machine having a two meter Fourdrinier with two press nips followed by a creping roll. The papermaking machine had a 35 can dryer section which was in four sections - see FIG. 1. The cationic polymers and anionic polymers were sprayed from two separate atomizing nozzles onto the top dryer fabric in the second section of the paper machine dryer. The pitch control agents were tested while the paper machine was producing 22 lb creped industrial toweling grade produced from 100% recycled fiber. The furnish was principally OCC off-cuts but also included some bails of lower quality and broke. Previous runs with this furnish required relatively frequent shutdown and cleaning of the dryer fabrics and dryer rolls with a proprietary caustic cleaner. The dryer fabric was a monofilament polyester plastic material. At the natural hood temperature, the dryer fabric which had been wetted with the aqueous polymeric treatments, was effectively dried prior to coming into contact with the paper sheet.

CATIONIC POLYMER TREATMENT

Five liters of a formulation of a quaternary epiamine polymer and a quaternary surfactant were diluted with 45 liters of water and applied through the first shower.

ANIONIC POLYMER TREATMENT

One liter of a lignosulfonate solution (1.25 Kg) was diluted into 36.5 l water and the pH was adjusted to 7-8 with $H_2SO_4$ for application through the second shower.

RESULTS

After 24 hours, the dryer fabric did not appear to have any more pitch deposits than were originally present at the beginning of the run. Previous experience, i.e. without the application of the cationic and anionic polymer treatments, had resulted in a black coated dryer fabric evidencing the high degree of pitch deposition. The results indicated that the treatment of the dryer fabric with the combination of a cationic polymer solution and an anionic aromatic polymer solution was effective in preventing pitch deposits from forming.

EXAMPLE 2

The experiment described in Example 1 was repeated except the following polymer treatments were used.

CATIONIC POLYMER TREATMENT

A blend of epiamine polymer and quaternary surfactant was diluted ten times with water and the resultant aqueous solution was applied at rates between 25 to 60 mL/min.

ANIONIC POLYMER TREATMENT

An anionic lignosulfonate was diluted 3.3 times in water and the resultant solution was applied at rates between 25 to 60 mL/min.

RESULTS

After 48 hours the dryer fabric did not appear to have any more pitch deposits than were originally present at the beginning of the run and was considered to be a success.

EXAMPLE 3

The procedure according to Example 2 was repeated except that a different dryer fabric was used, namely a 100% polyester mono/multi filament blend.

RESULTS

The combined polymeric treatments were applied continuously for nine days and effectively inhibited the deposition of pitch onto the dryer fabric. The following observations were made:

1) A minimal amount of pitch and/or stickies deposits accumulated.
2) There was no transfer of pitch and/or stickies deposits onto other felts.
3) There were no production problems during the entire run.

EXAMPLE 4

This example demonstrates the ineffectiveness of using only cationic treatments on dryer fabrics to control the deposition of pitch. The procedure according to Example 1 was repeated with the following treatments.

CATIONIC POLYMER TREATMENT

A blend of an epiamine polymer and a quaternary surfactant was diluted 10 times and applied at a rate of 60 mL/min.

ANIONIC POLYMER TREATMENT

None.

RESULTS

After 48 hours, the test was considered a failure because the dryer fabric was covered with pitch and/or stickies deposits. These results confirm that both cationic and anionic polymeric treatments are required.

We claim:

1. A method for controlling pitch deposits on paper making machine dryer fabrics or equipment surfaces which are not in continuous contact with process water comprising separately or simultaneously applying to the fabrics or equipment surfaces, a water-soluble or water dispersible cationic polymer having a molecular weight between 1000 and 500,000 and a charge density of between 0.1 and 10 and a water-soluble or water dispersible anionic aromatic polymer selected from the group consisting of lignins, lignin sulfonates, polynapthalene sulfonates, tannins, sulfonated tannins, their water soluble salts, and mixture thereof and wherein the polymer contains an aromatic moiety of at least 50% on a molar basis.

2. A method according to claim 1 wherein the molecular weight for cationic polymers is 20,000 to 500,000.

3. A method according to claim 1 wherein the charge density of the cationic polymers is 2 to 8 meq/g.

4. A method according to claim 1 wherein the molecular weight for the anionic polymers is 300 to 100,000.

5. A method according to claim 1 wherein the polymers are applied to the fabrics or equipment separately.

6. A method according to claim 1 wherein the pitch is derived from recycle fiber.

* * * * *

UNITED STATES PATENT AND TRADEMARK OFFICE

CERTIFICATE OF CORRECTION

PATENT NO. : 5,246,548

DATED : September 21, 1993

INVENTOR(S) : Aston et al

It is certified that error appears in the above-indentified patent and that said Letters Patent is hereby corrected as shown below: Column 8, In Claim 2, line 2, change "500,000" to

--50,000--.

Signed and Sealed this

Twenty-fifth Day of June, 1996

Bruce Lehman

*Attest:*

BRUCE LEHMAN

*Attesting Officer*

*Commissioner of Patents and Trademarks*